340-552 SR
9/10/85 OR 4,540,977

United States Patent [19]

Taillens et al.

[11] Patent Number: 4,540,977

[45] Date of Patent: Sep. 10, 1985

[54] SURVEILLANCE APPARATUS

[75] Inventors: Jean-Francois Taillens, Sullens; Heinz Lechner, Renens, both of Switzerland

[73] Assignee: 3S S.A., Geneva, Switzerland

[21] Appl. No.: 432,362

[22] Filed: Sep. 30, 1982

[51] Int. Cl.[3] ..... G08B 13/18

[52] U.S. Cl. ..... 340/552; 73/431

[58] Field of Search ..... 340/541, 556, 555, 557, 340/552; 174/59, 52 R; 73/431

[56] References Cited

U.S. PATENT DOCUMENTS

| | | | |
|---|---|---|---|
| 699,483 | 5/1902 | Brady | 174/59 |
| 1,620,047 | 3/1927 | Valkenberg | 174/59 |
| 3,752,978 | 8/1973 | Kahl, Jr. et al. | 340/556 X |
| 4,023,139 | 5/1977 | Samburg | 340/541 X |
| 4,198,653 | 4/1980 | Kamin | 340/541 X |
| 4,257,038 | 3/1981 | Rounds et al. | 340/541 X |
| 4,360,856 | 11/1982 | Witthaus | 340/541 X |

*Primary Examiner*—Jerry W. Myracle
*Attorney, Agent, or Firm*—Emory L. Groff, Jr.

[57] ABSTRACT

A surveillance apparatus against theft or intrusion includes a box containing a detector reacting to an abnormal presence and operable to selectively activate a camera, a flash and/or an acoustic warning device. The open rear of the box is hingedly attached to a support plate affixed to a wall while flexible wires from the box components include a connector part removably attachable to a mating connector part on the support plate, the latter being supplied with a source of power. A backup source of power may be included in the box as well as cooperating lock components on the box and support plate.

9 Claims, 4 Drawing Figures

SURVEILLANCE APPARATUS

Numerous security or surveillance units which can be installed in commercial or private buildings are already known. However, the cost of these units is high because they necessitate the installation of numerous electric cables, door or window contacts, etc.

Portable apparatus comprising an ultrasonic or infrared ray detector are also known. These latter apparatus do not constitute a good surveillance device because the individual who disturbs their operation can easily put them out of service or even break them.

This invention has as its object to make it possible to provide a surveillance apparatus for a building offering a higher security and whose manufacturing and installation cost can be kept much lower than that of the units mentioned above.

The invention has as another object an apparatus for offering security against theft, comprising detection and alarm means that react to an abnormal presence, these means being located inside a box that includes a removable support plate provided with means making it possible to attach it to a part of a building, wherein the support plate is provided with electric terminals to connect the apparatus to the power supply system, these terminals being connected to a part of the connector being connected by flexible wires to circuits forming part of said detection and alarm means, these means being attached in the box in such a way that they can be removed with the latter after separation of the two parts of the connector.

The accompanying drawing diagrammatically represents, by way of example, an embodiment of the apparatus that is the object of the invention.

Figure 1:
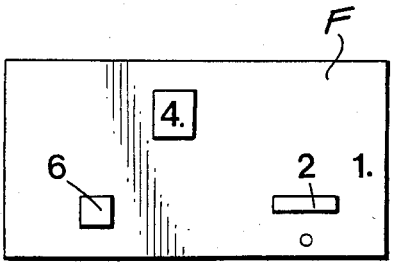
FIG. 1 is a front view of this apparatus.

FIG. 1 shows the front face F of a small box 1 containing all the devices necessary for providing surveillance. This front face exhibits a window 2 for an abnormal presence detector 3 such as an infrared radiation pickup, a window 4 that makes it posssible for a camera 5 housed in the small box to take a picture and a window 6 located opposite an electronic flash 7.

Figure 2:
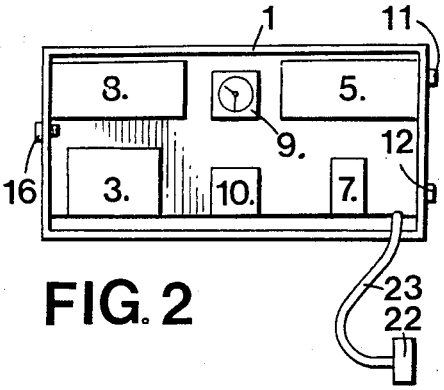
FIG. 2 is a view of the back face of the apparatus, this face being uncovered.
Figure 3:
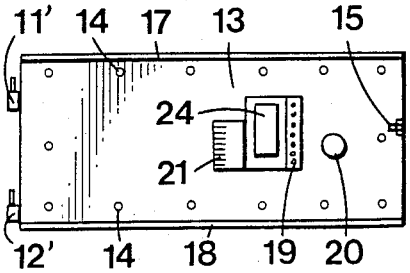
FIG. 3 shows a cover or support plate for the apparatus.

As diagrammatically represented in FIG. 2, the small box 1 contains also an alarm siren 8, a timing device 9 with a weekly cycle, which is intended to automatically engage the device for desired periods of surveillance, and an emergency battery 10 which makes it possible to supply the apparatus with power in case of a power system failure.

Small box 1 is made of relatively thick sheet steel so as to be strong. Of course, this small box can be covered with any material, in particular wood, to give it a more esthetic aspect.

On one of its edges, the small box 1 is provided with two hinge components such as pins 11 and 12 intended to engage with cooperating components such as hinge pins 11' and 12' on a cover or support plate 13, also made of sheet steel. This cover has several holes 14 that make it possible to attach it solidly to a part of a building, particularly to a wall, by means of screws. The cover 13 further carries a part 15 of a lock intended to cooperate with a lock part 16 attached to the small box 1 that makes it possible to lock small box 1 on cover 13 in a closed position. In the closed position of the apparatus, it is no longer possible to remove hinge pins 11 and 12 because cover 13 has two flanges that fit practically without play inside the opening of small box 1.

The small box further carries a series of electric terminals 19 intended to connect the apparatus to outside cables passing through a hole 20 of the small box. The cables are provided particularly for the supply of power to the apparatus by the power system. However, it is possible to provide additional cables, for example, to connect the apparatus to an outside alarm unit, an automatic alarm by telephone, a switch controlling the lighting of the building under surveillance, etc. The terminals 19 are connected to a first contact part 21 whose other or second contact part 22 is connected to the apparatus by flexible cables 23. The cover or support plate 13 holds also a relay contact 24 attached to cover 13 whose electric contacts are connected to certain terminals 19. In this way, it is possible to achieve a galvanic separation of the low voltage circuits contained in small box 1 and of the strong current circuits able to be controlled by relay 24.

The described arrangement is very advantageous because the installation of the apparatus does not necessitate a great deal of work requiring skilled labor. Cover 13 can be attached to a wall by anyone without special training and the connections of the wires to terminals 19 can be made rapidly when starting the apparatus. Then, all that is required is to hang the small box 1 from the hinge pins of the cover, plug in the contacts 21–22 and close the box 1 with its cover 13.

The detector 3 which reacts to an abnormal presence does not necessarily have to be of the type operating with infrared radiation. It could be replaced or supplemented with an ultrasonic detector or again by radar. Moreover, the apparatus could also comprise a receiver sensitive to radiation and intended to switch off surveillance by the apparatus for a predetermined time after receiving an appropriate radiation. The latter arrangement is advantageous particularly when the buildings, under surveillance must be inspected by persons making night rounds. A radiation receiver an an ouside accessory for the emission of a coded radiation, for example infrared, intended to act on said receiver to transmit data relating to turning on and off the circuit of the surveillance device can also be provided.

Figure 4:
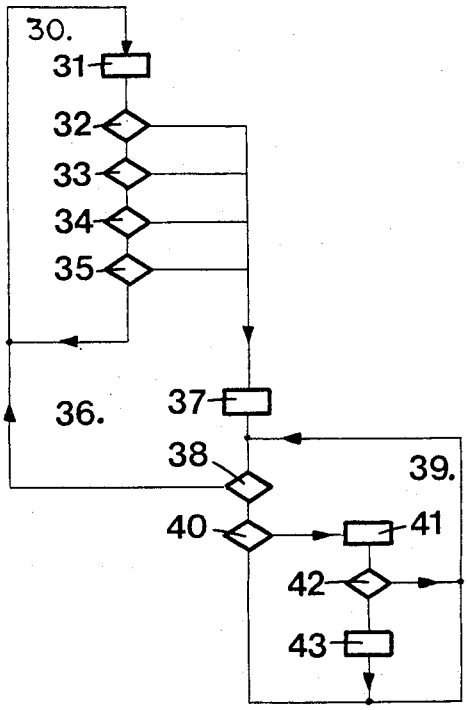
FIG. 4 is an operating diagram.

In another embodiment, a large part of the circuits could be replaced with a microprocessor. The operating diagram of this microprocessor is shown in FIG. 4. This diagram comprises a first loop 30 which it is successively verified, from a surveillance state 31, whether at 32 the unit is switched on by a key or a switch, at 33 by a radiation code, at 34 by a transmission of orders coming from the power system by a carrier current and at 35 by a timer. If an affirmative response to one of the criteria 32 to 35 is obtained, the signal then goes into a loop 36 comprising a device 37 that gives a weak acoustic signal for a period of one minute. Thus, when the apparatus is turned on, sufficient time passes to make it possible for the person having engaged the apparatus to leave the area and not be considered an intruder. Moreover, the person in question can stil cut off loop 36 by operating a cut-off switch which then sends the signal on loop 30. If criteria 38 is negative, the signal goes into a loop 39 comprising detector 40. When this signals something suspicious, it sends a signal to trip 41 of the photographic apparatus, then over a possible retarder 42 finally to end at a device 43 that engages the acoustic alarm.

The apparatus described is relatively low-cost because all of its components are grouped in a single small box, which makes mass production possible, the assembly and testing being able to be performed at the factory.

Of course, numerous modifications making it possible to obtain different methods of operation can be provided. In particular, the apparatus could comprise an emitter and a receiver for carrier frequency signals, these signals going through the electric power conductors. This arrangement makes possible an interconnection between several apparatus placed in different rooms of the same building. Thus, it can result that the reaction of the detector of an apparatus causes the camera of this apparatus to operate, with or without an alarm siren, while the alarm siren of at least one other identical apparatus would be put into action. The apparatus would also comprise means, for example a selection switch, making it possible to let the detector operate, this latter acting on an indicator light which, alone, can constitute a deterrent means, for example in a large department store to prevent shoplifting. This selection button can be placed in positions controlling either the operation of the camera alone, or the operation of the acoustic warning alone, or both together.

Of course, the apparatus could also be provided with connections for sending a signal, for example manually engaged, to activate the warning device.

We claim:

1. Apparatus for monitoring against theft, comprising detection and alarm means that react to an abnormal presence, said means mounted inside a box, said box provided with a fixed integral front face, a removable support plate provided with means making it possible to attach said support plate to a part of a building, said box provided with hinge components, intended to engage cooperating hinge components hinge components located along an edge of said support plate to allow opening of the rear of said box as said box is displaced about hinge components away from said support plate, the opposite edge of said support plate including a part of a lock whose other part is attached to said box, said support plate provided with electric terminals to connect the apparatus to a source of power, said terminals connected to a first contact part of a connector attached to the support plate, a second contact part of the connector being connected by flexible wire to circuits forming part of said means of detection and alarm within said box, said detection and alarm means attached in the box so as to be able to be removed with the box after said displacement of said box away from said support plate and subsequent separation of said first and second contact parts of the connector, and said alarm means including an acoustic warning device activated by said detection means.

2. Apparatus according to claim 1 wherein, said support plate includes a relay whose electric contacts are intended to be connected to an outside alarm device.

3. Apparatus according to claim 1 including, a timing device with a weekly cycle to engage the desired periods of monitoring and non-monitoring automatically.

4. Apparatus according to claim 3 wherein, said detection and alarm means includes a receiver sensitive to radiation and intended to switch off the activation of the apparatus for a predetermined time after receiving appropriate radiation.

5. Apparatus according to claim 4 including, an infrared radiation receiver and an ouside accessory for emission of a coded infrared radiation intended to act on said receiver to transmit information relating to turning the circuit of the apparatus on and off.

6. Apparatus according to claim 1 including, a photographic camera and means for activating said camera by said detecton means.

7. Apparatus according to claim 1 including exterior signal receiving means to activate said alarm means.

8. Apparatus according to claim 7 including, means sensitive to a reaction of the detector and intended to activate the alarm device of another apparatus for providing an interconnection between several said apparatuses.

9. Apparatus according to claim 1 wherein, said alarm means includes a signal light whose intensity varies each time said detection means reacts to an abnormal presence, and selective means to cause or not cause the actuation of said signal light by said detection means.

* * * * *